United States Patent [19]

Gainer et al.

[11] 4,355,960

[45] Oct. 26, 1982

[54] COMPRESSOR REFRIGERATION SYSTEM UTILIZING THERMALLY STABLE REFRIGERATION LUBRICANTS CONTAINING ALKYL POLYHALOPHENYL ETHERS

[75] Inventors: Gordon C. Gainer, Penn Hills; Russell M. Luck, Monroeville, both of Pa.

[73] Assignee: Westinghouse Electric Corp., Pittsburgh, Pa.

[21] Appl. No.: 157,995

[22] Filed: Jun. 9, 1980

[51] Int. Cl.[3] ..... C10M 1/30; F04D 17/00

[52] U.S. Cl. ..... 417/419; 62/469; 62/470; 252/54; 252/68; 570/102

[58] Field of Search ..... 252/54, 68, 396, 407; 568/647, 655; 570/102; 62/470

[56] References Cited

U.S. PATENT DOCUMENTS

| | | | |
|---|---|---|---|
| 1,936,670 | 11/1933 | Henriksen et al. | 252/54 |
| 2,027,797 | 3/1937 | Clark et al. | 568/656 |
| 2,137,784 | 11/1938 | Prutton et al. | 252/54 |
| 2,702,825 | 2/1955 | Ross et al. | 252/54 X |
| 2,943,057 | 6/1960 | Eiseman | 252/68 |
| 3,499,840 | 3/1970 | Williams | 252/54 |
| 3,715,302 | 2/1973 | Mills et al. | 208/14 |
| 3,878,112 | 4/1975 | Luck et al. | 252/10 |
| 4,046,533 | 9/1977 | Olund | 62/468 |

FOREIGN PATENT DOCUMENTS

| | | |
|---|---|---|
| 216100 | 7/1958 | Australia . |
| 1184349 | 12/1964 | Fed. Rep. of Germany . |

*Primary Examiner*—P. E. Willis, Jr.
*Attorney, Agent, or Firm*—D. P. Cillo

[57] ABSTRACT

A compressor refrigeration system employing a halocarbon refrigerant, has a lubricant composition in contact with the halocarbon refrigerant over the expected temperature range of the system, the lubricant composition having lubricity and chemical and thermal stability in the presence of halocarbon refrigerant at temperatures of up to at least 130° C., the lubricant composition comprising a thermally stable oil with minor amounts of an alkyl polyhalophenyl ether.

9 Claims, 4 Drawing Figures

COMPRESSOR REFRIGERATION SYSTEM UTILIZING THERMALLY STABLE REFRIGERATION LUBRICANTS CONTAINING ALKYL POLYHALOPHENYL ETHERS

BACKGROUND OF THE INVENTION

The present invention relates to novel lubricant compositions for use in refrigeration systems, primarily of the reciprocating i.e., piston driven compressor type, which normally operate at discharge temperatures of between 90° C. to 130° C. In particular, the present invention relates to lubricant compositions having high lubricity which are thermally and chemically stable in the presence of and in contact with hot halocarbon refrigerant vapor, such as chlorofluorocarbon vapor.

Refrigerant systems utilizing halocarbon refrigerants such as dichlorofifluoromethane (R-12) and chlorodifluoromethane (R-22) require very highly specialized lubricants. Such systems may include not only food refrigerators, but home air conditioners and heat pumps, which in winter operate by extracting heat from cold outdoor air. These lubricants must be resistant to thermal and chemical decomposition at high temperatures present during gas compression, in the presence of and in contact with highly corrosive and extremely reactive chlorofluorocarbon vapors, and must also provide adequate lubrication of bearings and piston-cylinder surfaces during cold start-up.

At low temperature, chlorofluorocarbon refrigerants are highly soluble in lubricating oils, and depending on the particular chlorofluorocarbon and the temperature, separation occurs into two phases, one of high chlorofluorocarbon content and the other high in oil and low in chlorofluorocarbon. During cold operation or during the cold-cycle in the reciprocating compressor system, this dilution of oil with chlorofluorocarbon results in poor lubrication which causes high cylinder and bearing wear, often accompanied by galling and seizing. This in part is caused by the condensation of the refrigerant in the crankcase in the cold atmospheric environment, so that the lubricant is diluted with refrigerant.

During start-up and with reduced suction pressure being applied, the lubricant in the crankcase is swelled with gaseous refrigerant, as the liquid chlorofluorocarbon boils out of the oil. A foam is produced, making it extremely difficult to maintain oil pressure. Thus, foamed oil is delivered through the galleries to the and crank shaft bearings. This situation is aggravated when R-22 refrigerant is used because phase separation of the liquid refrigerant and lubricant occurs and a highly diluted oil-froth emulsion and foam of very low viscosity is delivered to the bearings and cylinder walls.

It is also well known that chlorofluorocarbon refrigerants very vigorously chemically attack the lubricants and metal compressor parts, particularly at temperatures of over about 100° C. "Coking" or carbonization in the region of and on the pistons and hot discharge valves, results from the thermal decomposition of lubricating oil vapor and mist, in the presence of hot compressed refrigerant vapor near the hot discharge valves of the compressor. The temperature in this region can exceed the 130° C. bulk gas temperature. Even higher instantaneous temperatures are encountered in the shock wave produced in each compression stroke. It is known that the metals present in this area act as catalysts to cause reaction of the chlorofluorocarbon with the oils and additives to form gummy reaction products.

It is largely for these reasons that ordinary non-refrigeration lubricants cannot be tolerated in refrigeration compressors utilizing chlorofluorocarbons.

Eiseman, in U.S. Pat. No. 2,943,057 sought to solve "copper plating" and moisture problems in reciprocating compressor refrigerant systems employing chlorofluorocarbon refrigerants. Eiseman found that under some conditions of operation, the chlorofluorocarbon refrigerant and lubricating oils break down and form reactive corrosion products which dissolve small amounts of copper. This copper is redeposited on the pistons, cylinders and valves of the compressor unit. In addition, under some circumstances, moisture trapped in chlorofluorocarbon refrigeration systems can freeze in the copper capillary tubes of the system, blocking passage of liquid refrigerant. Eiseman solved the "copper plating" problem by using polyacrylonitrile fabric as a slot liner, phase separator and winding insulation in the motor of the refrigeration system. The moisture freezing problem was solved by including a water soluble antifreeze additive such as methanol, in the lubricating oil, which consisted of highly refined petroleum oil.

Mills et al., in U.S. Pat. No. 3,715,302, taught an improved hydrofined hydrocarbon oil as the sole lubricant in reciprocating refrigeration compressor systems operating at up to 140° C. in a chlorofluorocarbon environment. A dual naphthenic-paraffinic high boiling petroleum oil is taught, where the nitrogen content of the blend and/or one or more of the component oils is reduced to less than 10 ppm. by an acid or acid-activated clay refining treatment. These low nitrogen content lubricating oils exhibited good chemical and thermal stability in contact with chlorofluorocarbon refrigerants, good miscibility with chlorofluorocarbon refrigerants, and improved coke deposit problems in the refrigeration system.

Luck et al., in U.S. Pat. No. 3,878,112, recognized problems in cold start up of centrifugal type compressors, which normally operate in chlorofluorocarbon refrigeration systems at moderate discharge temperatures of between 70° C. to 90° C. Here, large volumes of dichlorodifluoromethane are dissolved in the cold lubricating oil on shutdown, reducing oil viscosity and deleteriously affecting oil pressure and lubricity properties during startup. Luck et al., for centrifugal compressors, used an oil consisting of diricinoleic esters of 2 to 5 carbon atom hydrocarbon glycols, such as ethylene glycol, propylene glycol, 1,4-butanediol and 1,5-pentane-diol, instead of naphthenic and alkylated benzene oils. These synthetic lubricants had viscosities up to 600 SUS at 38° C. Luck et al. may optionally incorporate into the ester based oil, small quantities of extreme pressure lubricant additives, such as dodecylmonochlorodiphenyl oxide i.e.:

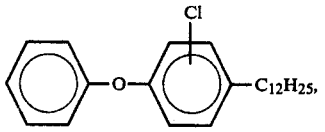

to help resist degradation caused by the 18,000 to 36,000 rpm. centrifugal impeller operating speed, and anti-wear agents, such as tricresyl phosphate.

The synthetic oils, taught by Luck et al., are too viscous, and would not be sufficiently chemically stable in the drastically more thermally severe reciprocating refrigeration compressor environment. What is needed is a refrigerant lubricant composition, primarily adapted for reciprocating type refrigeration compressor environments, which can resist intimate contact with reactive and corrosive chlorofluorocarbon refrigerants, especially in the hot discharge regions, at temperatures up to at least 130° C., without excessive thermal or chemical degradation. The composition should also promote and provide improved lubricity in the hot upper cylinders and discharge regions of the reciprocating compressor.

SUMMARY OF THE INVENTION

The above problems have been solved, and the above need met, by inclusion of a specific type of alkyl polyhalo-phenyl ether in the lubricating oil of refrigeration compressors, primarily of the reciprocating type, operating in a halocarbon environment at elevated temperatures. More specifically the alkyl polyhalophenyl ether has the chemical formula:

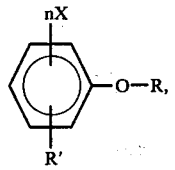

where R=an alkyl group having from 4 to 18 carbon atoms, n=a number from 1 to 4, preferably 2 to 4, X=Cl, F, and their mixtures, and R' is a group selected from the group consisting of Cl, F, H, alkyl having from 4 to 18 carbon atoms,

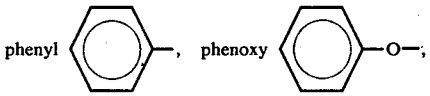

and their combination; where, critically, the R alkyl group is bonded to the chlorine or fluorine substituted benzene ring through an oxygen atom. Preferably X is Cl. X cannot be bromine or iodine, as these halogens tend to be very unstable with chlorofluorocarbons and hydrocarbon oils at high temperatures. This alkyl polyhalophenyl ether can be added to a lubricating oil, preferably having a viscosity of from about 75 SUS to about 500 SUS at 38° C., in a minor amount, i.e., in the range of from about 1 part to 20 parts/100 parts of lubricating oil to provide an outstanding lubricant composition. The —O—R linkage, unexpectedly, dramatically improves thermal aging properties of the additive when in contact with hot halocarbons.

This provides a lubricant composition that can be used in a reciprocating compressor refrigeration system, and be in and withstand vapor contact with highly reactive and corrosive chlorofluorocarbon refrigerant and other materials in the refrigeration system at temperatures up to at least 130° C., while maintaining its chemical stability, thermal stability and lubricity. This lubricant composition is thus useful in one of the most thermochemically degrading environments in which lubricants are required to act, i.e., R-12 or R-22 high temperature reciprocating refrigeration systems. Here even relatively miniscule thermal and chemical decomposition will produce gums and resins that will plug up delicate expansion valves and capillary tubes and other passageways through which the liquid refrigerant must pass in controlled amounts.

BRIEF DESCRIPTION OF THE DRAWINGS

For a better understanding of the invention, reference may be made to the exemplary embodiments shown in the accompanying drawings in which.

DESCRIPTION OF THE PREFERRED EMBODIMENTS

Figure 1:
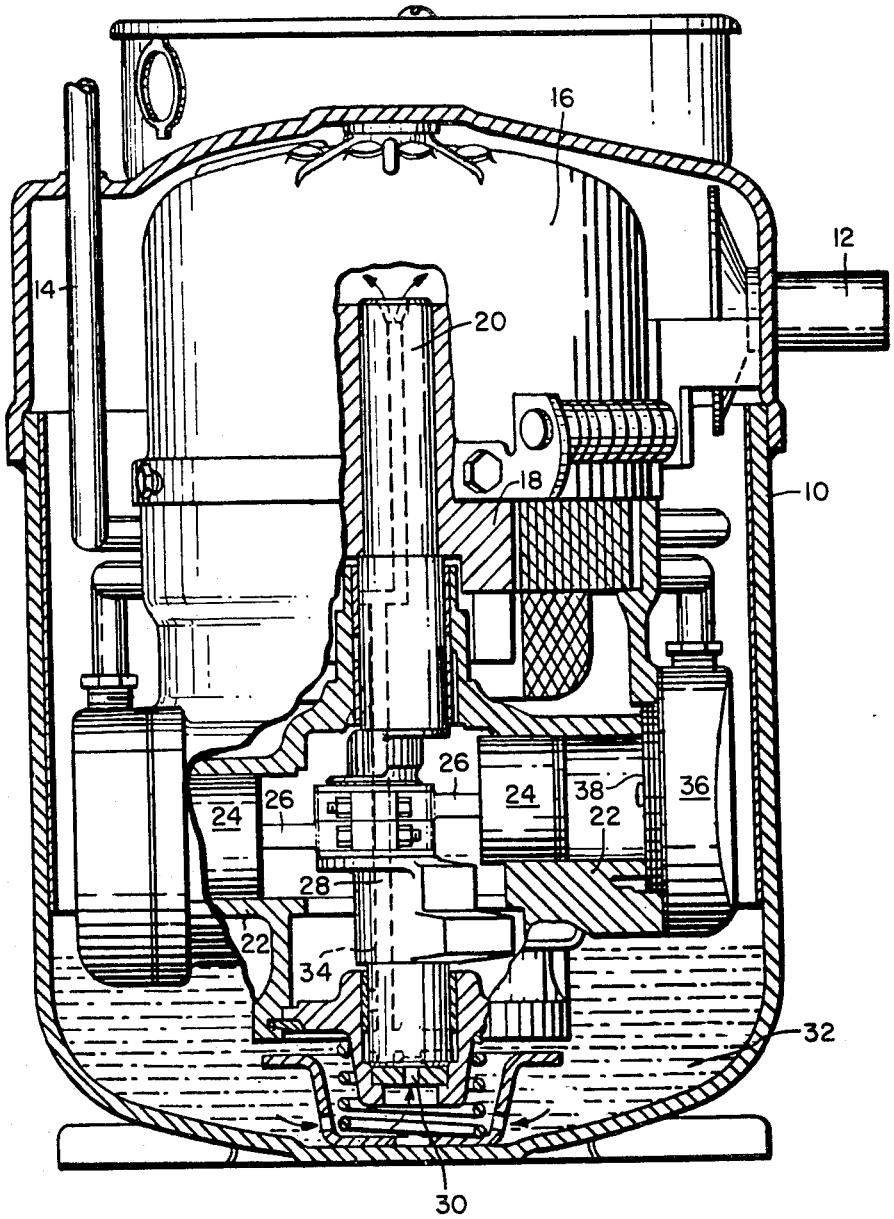
FIG. 1 is a side view, partially in section, of one type of reciprocating refrigeration compressor system, which can utilize the lubricant composition of this invention, showing the location of the pistons and valves where extreme operating temperatures and conditions are encountered.

The oil used as the base of the new and improved lubricating composition of this invention will have a viscosity preferably of from about 75 SUS to about 500 SUS at 38° C., and most preferably from about 75 SUS to about 300 SUS at 38° C., with pour points preferably not greater than about −25° F. The oil can be a highly refined naphthenic base petroleum oil (well known in the art, for example Suniso series 3GS, 4GS or 5GS) but preferably is either a highly stable hydrofined mineral oil (well known in the art, for example Tufflo series 6004, 6014, and 6024) or a polyalkylated benzene synthetic lubricant oil (well known in the art, for example Zephron 150).

Hydrofined oil, such as produced by high pressure hydrogeneration of oil in the presence of catalysts at high temperatures, has been found to be extremely resistant to thermal degradation in the presence of R-12 or R-22 chlorofluorocarbon refrigerants at over 130° C., and is thus particularly well suited as the oil base of the present invention. The thermal and chemical stability of the hydrofined oils toward chlorofluorocarbon refrigerant is believed to result largely from the removal of practically all of the remaining amounts of hydrocarbons containing nitrogen, sulfur and oxygen, and from the hydrogenation of the unsaturated hydrocarbons usually found in commercial refrigerator compressor oils.

While these fully hydrofined oils provide excellent thermal stability and chemical stability toward chlorofluorocarbon refrigerants, they generally have poor lubricating qualities. Accordingly, used alone these mineral base oils are usually unsatisfactory as lubricants for chlorofluorocarbons refrigerant systems.

Outstanding results have been obtained by using as the oil component of the lubricant composition certain polyalkylated benzene compounds. The general formula for these compounds is:

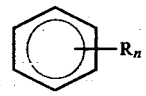

where R represents alkyl groups having an average of from 8 to 24 carbon atoms, either straight chain or branched, and "n" represents a number from 2 to 4. The alkyl groups may be the same or different, and may be attached to different benzene carbon atoms in each successive molecule. These alkylated benzenes usually comprise a mixture of compounds in some of which only a few alkyl groups may be present, while others may have 4 or 5 alkyl groups. Examples of such compounds are the di- and tri- dodecyl benzenes, and di- and tetra-hexadecyl benzenes. Fractional distillation is employed to separate the lower molecular weight products, such as the monoalkyls, then the next fraction separated out will comprise progressively higher substituted compounds, namely those having two or more alkyl groups.

The useful thermolubricity additive of this invention is an alkyl polyhalophenyl ether, selected from alkyl polychlorophenyl ether, alkyl polyfluorophenyl ether, and alkyl poly(chlorofluoro)phenyl ether i.e., having at least one chlorine and/or at least one fluorine atom per molecule, and mixtures thereof, having the following chemical formula:

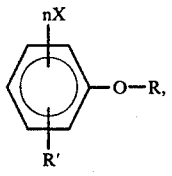

where R=an alkyl group having from 4 to 18 carbon atoms, n=a number from 1 to 4, preferably 2 to 4, X=Cl, F and their mixtures, and R' is a group selected from the group consisting of Cl, F, H, alkyl having from 4 to 18 carbon atoms,

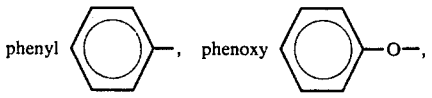

and their combination; where the R alkyl group is bonded to the X substituted benzene ring through an oxygen atom, and the position of R' and the chlorine and/or fluorine atoms can vary. Preferably, X is Cl. X cannot be bromine or iodine, as these halogens tend to be very unstable with chlorofluorocarbons and hydrocarbon oils at high temperatures. This alkyl polyhalophenyl ether is substantially completely soluble in the base oil over the expected temperature range of the refrigeration system, and is added in the range of from about 1 part to about 20 parts by weight per 100 parts by weight of base lubricating oil.

The lubricant composition provided is highly resistant to chemical reaction with the chlorofluorocarbon and/or the materials in the refrigeration system at the expected temperatures and operating conditions of the refrigeration system. Use of over about 20 parts of the thermolubricity additive, thermal and chemical stability of the lubricant composition in the presence of hot chlorofluorocarbon contact begins to suffer. Use of under about 1 part, lubricating ability of the lubricant composition in the presence of hot chlorofluorocarbon is not sufficiently effective.

The attachment of one or more chlorine and/or fluorine atoms to the required benzene ring of the molecule imparts extremely good lubricity. The greater the number of chlorine and/or fluorine atoms, the greater the lubricity and the less additive required, therefore at least two fluorine and/or chlorine atoms are preferred. Bonding of the alkyl group, R, to the halogen substituted benzene ring through an oxygen atom is critical, and adds significantly to chemical stability and thermal aging properties in the presence of chlorofluorocarbon refrigerant. The oxygen atom ether linkage, between the alkyl, R, group and the halogen substituted benzene ring, is found to be chemically inert toward chlorofluorocarbon. Also, outstanding lowering of the freezing point is accomplished by the proper selection of the alkyl ether group, and the viscosity-temperature characteristics are found to improve in these alkyl ether type structures. Finally, the alkyl ether molecular structure allows one to easily change the properties desired in a given molecule by rearranging the number of halogen atoms on the phenyl group and varying the chain length and degree of branching in the alkyl ether portion of the molecule. The alkyl group, R, is preferably long chained, i.e., 8 to 18 carbon atoms, and the chains preferably are branched, to reduce the vapor pressure, and to increase the boiling point of the additive.

Some examples of useful thermolubricity additives include, among others, 2-octyl pentachlorophenyl ether; 2-octyl 2,5-dichloro 3,6-difluoro phenyl ether; octadecyl 2,4,6-trichlorophenyl ether; 2-ethylhexyl 2,4-dichlorophenyl ether; and 2-octyl 2,4-dichlorophenyl ether. The majority of these materials can be easily and inexpensively synthesized by reacting the sodium salt of the selected chlorinated or fluorinated phenol with the desired alkyl halide by refluxing in a suitable solvent. The solvent is chosen, in part, to elevate the boiling point of the reaction mixture. This is followed by appropriate work up and distillation or crystallization of the desired product.

The well recognized and commercially available anti-wear additives used in many premium hydraulic and automotive oils such as, for example, the tricresyl phosphate esters and the family of zinc dialkyl dithiophosphates, are not particularly advantageous for use in the reciprocating type refrigerant system of this invention, and are specifically excluded from the lubricating compositions described herein. When these additives are present, the lubricants are vastly inferior, with regard to thermal stability, as compared to the lubricating compositions of the present invention, by virtue of gross chemical attack by the chlorofluorocarbon refrigerants.

Referring now to the drawing, one type of reciprocating compressor 1 for a refrigerant system is shown. The lubricant composition of this invention can be used in a wide variety of standard systems, as well as in the rather sophisticated hermetically sealed refrigeration compressor shown. The generally cylindrical shell 10 has an inlet 12 through which the chlorofluorocarbon gas refrigerant in the suction line is admitted to the shell, and one or more discharge gas tubes 14 through which the compressed gas exits from the shell. The upper part of the shell houses an electric motor 16 whose rotor 18 is fixed to the upper end of the crankshaft 20 to rotate the crankshaft.

In the illustrated unit, the compressor has two cylinders 22 in which the two pistons 24 reciprocate as they are driven by the connecting rods 26 which have their one ends connected to the pistons and their other strap ends rotatably coupled to that lower portion 28 of the crankshaft which is provided with the crankpins of the crankshaft. The extreme lower end portion of the crankshaft 28 includes lubricant inlet means 30 for admitting lubricating oil from the sump 32 into a vertically extending passage 34 in the crankshaft to carry oil to the bearings. The cylinders 22 are closed by heads 36 which contain suction and discharge valves which are not completely shown.

The shock wave temperature at the surface of some portions of the hot discharge valve and piston, at the top of the compression stroke, can exceed the bulk gas discharge temperature, which has been measured as high as 130° C. At these points especially, as at point 38, contact of lubricant composition with vapor phase chlorofluorocarbon in the presence of hot copper and/or aluminum and/or steel, acting as a catalyst, will provide a uniquely harsh environment which promotes refrigerant reaction and thermal and chemical decomposition of the lubricant composition.

In the examples below, lubricating ability of the lubricant composition was evaluated using the Falex E.P. (seizure) test and the Falex Wear Test. Resistance to refrigerant was assessed by evaluation in the Sealed Tube Test. In the Falex E.P. (seizure) Test, data is provided on the lubricating ability of the lubricants in terms of maximum load carrying ability to the point of failure. In this test, the higher the value, the better the lubricant. The Falex Wear Test involves the application of a known load to two self-aligning V-blocks that squeeze a small rotating shaft. In testing, a new test piece is broken in at about 50 pounds (gauge-load) for 10 minutes, followed by running at a 200 pound (gauge-load) for 10 minutes, followed by a 200 pound (gauge-load) run for 5 minutes. A 250 pound (gauge-load) is then applied for the duration of the test, which is approximately 4 hours. A 250 pound (gauge-load) pressure in this test corresponds to from about a 15,000 psi to 20,000 psi. load on the projected wear area, and represents a very severe test for boundary lubricating ability. Any wear which occurs on the test pieces is reflected by a drop in the applied load as indicated on the gauge. Thus, every fifteen minutes, the applied gauge-load is readjusted to 250 pounds (gauge-load) and the take-up, on a calibrated wheel, is recorded as wear units. The wear in the following table is expressed as "wear units per hour" and represents the total number of wear units recorded over a four-hour period divided by four. For details, see "Falex Lubricant Testing Machine" Instruction Manual issued by Faville-Le Valley Corp., Bellwood, Ill. In this test, the lower the value, the better the lubricant.

With regard to thermal and chemical stability, the standard "Sealed Tube Test" has been utilized. This test is described in detail by H. Elsey in "Small Sealed Tube Procedure for Quality Control of Refrigeration Oils", 71 ASHRAE Transactions, Pt. 1, p. 143 (1965). Generally, this test involves the introduction of equal amounts of lubricant and refrigerant, together with samples of the compressor metals with which the lubricant and refrigerant come in contact, into a clean, dry glass tube. The loaded tube is sealed and heated to the requisite temperatures and held for a long period of time. These tubes are visually inspected at set time intervals and changes in color and appearance of the lubricant noted. Such color changes are measured against standard color photographs illustrating a color scale from 1=transparent (no decomposition) to 12=black (failure decomposition).

EXAMPLE 1

This example involved the preparation of solid octadecyl 2,4,6-trichlorophenyl ether. In this preparation, 316 g. of the sodium salt of 2,4,6-trichlorophenol (1.6 moles) was reacted with 461.6 g. (1.6 moles) of 1-chlorooctadecane, by refluxing for 48 hours in a mixture of 1,250 ml. of butyl Cellosolve, containing 200 ml. of water. As the reaction proceeded, water was removed by means of a Dean Stark trap, to bring the reflux temperature to approximately 170° C.

Figure 2:
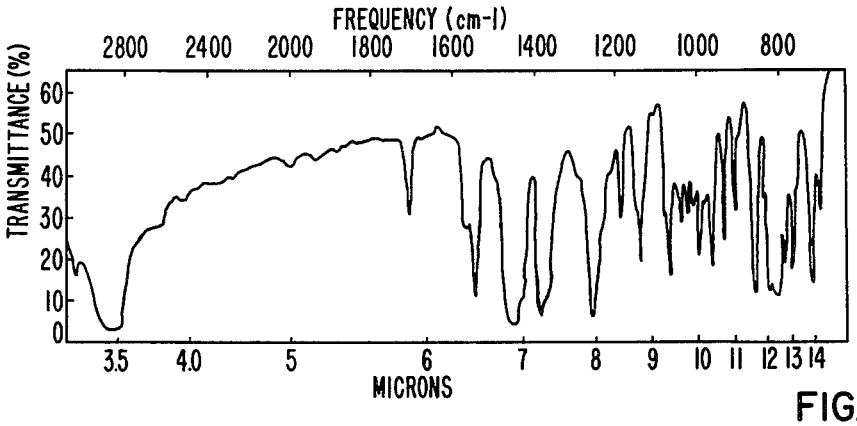
FIG. 2 is the infrared spectra for the material prepared in Example 1.

After cooling, the reaction mixture was diluted with 1,000 ml. of deionized water, and the resulting white crystalline product was precipitated. This crystalline product was repeatedly extracted with cool toluene. The combined extracts were dissolved in warm toluene and washed to neutrality with warm deionized water, and finally dried over anhydrous sodium carbonate. Three samples of crystalline product were obtained by evaporative crystallization from the dried toluene solution. Yields and melting points were as follows: First sample: 269 g. (37%) mp. 47° C. to 50° C. Second sample: 288 g. (40%), mp. 42° C. to 44° C. Third sample: 15 g. (2.1%) mp. 41° C. to 44° C. The overall yield was 79.1%. A portion of the first sample was recrystallized to constant melting point (49° C. to 50° C.) from a solution of methanol containing 10% toluene, to establish the melting point characteristic of the pure compound. Infrared spectra for this material are shown in FIG. 2 of the drawings.

EXAMPLE 2

This example involved the preparation of liquid 2-ethylhexyl 2,4-dichlorophenyl ether. In this preparation, 6.78 g. of sodium hydroxide (0.16 mole) was dissolved in 100 ml. of water and added to 26.08 g. (0.16 mole) of 2,4-dichlorophenol, and the solution was stirred for 1 hour at 60° C. Then, 22.3 g. (0.15 mole) of 2-ethylhexyl chloride was added in a thin stream, and the mixture was refluxed for 18 hours. At this point, 125 ml. of butyl Cellosolve was added and the water was removed using a Dean Stark trap, to retain the alkyl chloride. Thereupon, the solution was refluxed at 170° C. for 24 hours.

Figure 3:
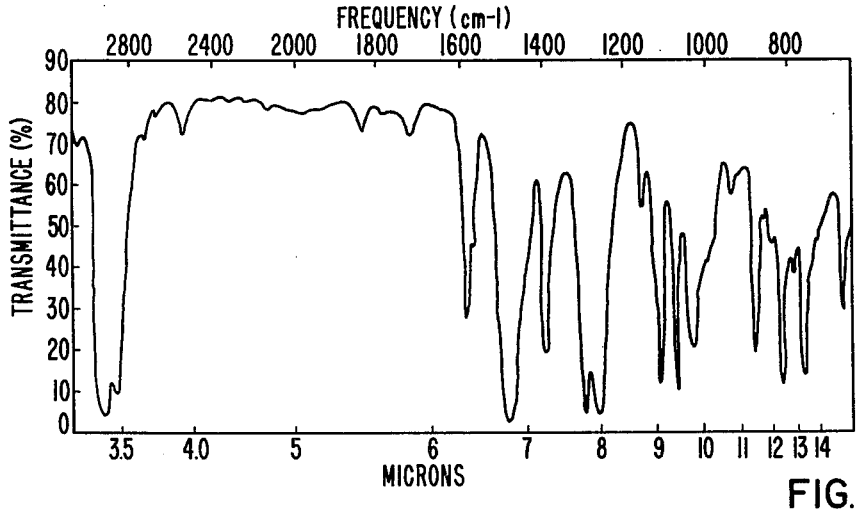
FIG. 3 is the infrared spectra for the material prepared in Example 2.

After cooling, the reaction mixture was poured into 2 liters of water and the organic layer was removed using a separatory funnel. After washing several times with deionized water the product was dried over anhydrous calcium sulfate. After drying, the fluid was distilled under vacuum. The main product (18.5 g. 43%) was distilled at 114°-118° C./0.2 mm.Hg. The refractive index was $n_D^{23}$ 1.5119, using an Abbe refractometer. The pour point of the 2-ethylhexyl 2,4-dichlorophenyl ether fluid was found to be below −60° F. Infrared spectra for this material are shown in FIG. 3 of the drawings.

EXAMPLE 3

This example involved the preparation of liquid 2-octyl 2,4-dichlorophenyl ether. This compound was prepared by reacting 34.23 g. (0.21 mole) of 2,4-dichlorophenol with 29.74 g. (0.20 mole) of 2-chlorooctane, in the presence of 8.9 g. (0.21 mole) of sodium hydroxide in 200 ml. of water. The reacting conditions, solvent medium (butyl Cellosolve) and work up, were the same as described in Example 2.

Figure 4:
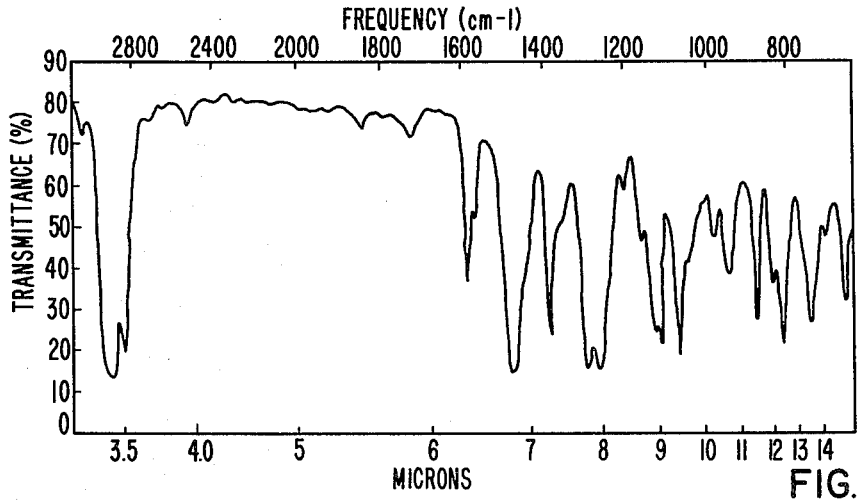
FIG. 4 is the infrared spectra for the material prepared in Example 3.

After drying, the liquid product (18 g., 31.1%) was distilled at 122° C. to 125° C./0.6 mm.Hg. The refractive index was $n_D^{23}$ 1.5098, using an Abbe refractometer. The pour point of the 2-octyl 2,4-dichlorophenyl ether fluid was found to be below −60° F. Infrared spectra for this material are shown in FIG. 4 of the drawings.

In the Falex tests, 5 parts by weight of the alkyl polychlorophenyl ethers of Examples 1, 2 and 3 were added to 95 parts by weight of a synthetic alkylated benzene oil having a viscosity of about 150 SUS at 38° C. and a pour point of −35° C. (sold commercially under the trade name Zephron 150 by DuPont) to provide Samples 1, 2 and 3 respectively. For comparison, Falex tests were also run on Zephron 150 with no additive, Sample 4, and on a fluid consisting of 5 parts by weight of dodecylmonochlorodiphenyl oxide added to 95 parts by weight of Zephron 150, Sample 5. The results are shown below in Table 1:

TABLE 1*

Falex Seizure and Wear Tests

| Sample | Base Oil | Additive | Amt. | Falex Seizure gauge-load (lbs.) | Falex Wear at 250 lbs. gauge-load (units/hr) |
|---|---|---|---|---|---|
| 1 | Zephron 150 | Octadecyl 2,4,6-trichlorophenyl ether | 5% | 750 | 23 |
| 2 | Zephron 150 | 2-ethylhexyl 2,4-dichlorophenyl ether | 5% | 1,000 | 19 |
| 3 | Zephron 150 | 2-octyl 2,4-dichlorophenyl ether | 5% | 1,000 | 27 |
| 4** | Zephron 150 | — | — | 500 | Failed |
| 5** | Zephron 150 | Dodecylmonochloro diphenyl oxide | 5% | 750 | 19 |

*All tests were run, steel vs. steel, using SAE 3135 test pins and SAE 1137 V-blocks.
**Comparative Examples.

Thermal aging tests were carried out in sealed tubes at 175° C. for 490 days on 5 parts and 7.5 parts by weight of the alkyl polychlorophenyl ether of Example 1 added to 95 parts and 92.5 parts respectively by weight of Zephron 150, Samples 1 and 1′ respectively, Table 2. In addition, this test was run on Zephron 150 alone, Sample 4, Table 2, and with 5 parts by weight of dodecylmonochlorodephenyl oxide per 95 parts Zephron 150, Sample 5, Table 2. The results are shown below in Table 2, involving, in the one case, equal amounts of R-22, chlorodifluoromethane and in the other case, equal amounts of R-12, dichlorodifluoromethane:

TABLE 2*

Sealed Tube Thermal Aging Tests

| Sample | Base Oil | Additive | Amt. | Rating in R-22 at 175° C. | Rating in R-12 at 175° C. |
|---|---|---|---|---|---|
| 1 | Zephron 150 | Octadecyl 2,4,6-trichlorophenyl ether | 5% | 0.5 | 8.5 |
| 1′ | Zephron 150 | Octadecyl 2,4,6-trichlorophenyl ether | 7.5% | 1.5 | 7.5 |
| 4** | Zephron 150 | — | — | 0.5 | 5.5 |
| 5** | Zephron 150 | Dodecylmono-chlorodiphenyl oxide | 5% | 1.5 | 9.5 |

*1 = clear (no decomposition); 12 = black (complete decomposition)
**Comparative Examples.

As can be seen from Table 1, an additive to the base oil is essential to provide adequate lubricity under severe operating conditions. The Zephron 150 without an additive failed the Falex Wear Test and had a maximum seizure load capacity of only 500 lbs. in the Falex Seizure Test. The alkyl polychlorophenyl ethers of this invention are shown to promote lubricating ability very similar to the dodecylmonochlorodiphenyl oxide additive in the Falex Wear Test. Moreover, in the Falex Seizure Test, they generally exceeded the values obtained with the dodecylmonochlorodiphenyl oxide additive in ultimate seizure load capacity. In the Falex Wear Test, values below 30 units/hr. are considered outstanding, the lower the unit/hr. value the better the lubricant. In the Falex Seizure Test, values over 550 pounds are considered outstanding, the higher the withstood load value the better the lubricant.

In Table 2, the alkyl polychlorophenyl ethers are shown to exhibit their superior resistance to decomposition in contact with R-22 and R-12 chlorofluorocarbon refrigerants at 175° C. Here, the lower the value the better the chemical and thermal resistance to hot chlorofluorocarbon refrigerant, and the more resistant the lubricant composition will be to decomposition in the vicinity of the hot discharge valves in a reciprocating refrigeration compressor. Values below 9.0 are considered outstanding resistance in to R-12, and values below 4.5 are considered outstanding in resistance to R-22. As can be seen, the R-12 is far more chemically reactive with the lubricants than is R-22 refrigerant. The Zephron 150 alone is very stable, but as shown in Table 1, it is very poor in lubricating ability. Here, the alkyl polychlorophenyl ether additive showed superior results as compared to the dodecylmonochlorodiphenyl oxide. Overall, the alkyl polychlorophenyl ether is shown to be the superior additive for halocarbon containing reciprocating compressor environments. Similar results would be obtained with alkyl polyfluorophenyl ethers or alkyl poly(chlorofluoro)phenyl ethers.

We claim as our invention:

1. A compressor refrigeration system employing a halocarbon refrigerant, having a lubricant composition in contact with the halocarbon refrigerant, the lubricant composition having lubricity and chemical and thermal stability in the presence of halocarbon refrigerant at temperatures of up to 130° C., the lubricant composition consisting essentially of a thermally stable oil containing a minor amount of a thermolubricity additive having the chemical formula:

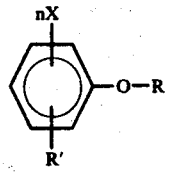

where R=an alkyl group having from 4 to 18 carbon atoms, n=a number from 1 to 4, X=CL, F and their mixtures and R' is a group selected from the group consisting of CL, F, H, alkyl having from 4 to 18 carbon atoms, phenyl, phenoxy, and mixtures thereof, said additive being substantially completely soluble in the oil over the expected temperature range of the refrigeration system, the additive providing for good lubricity and thermal stability in the lubricant composition at cold start-up, and at hot compressor operating temperatures while in vapor contact with hot halocarbon refrigerant, and the lubricant composition being highly resistant to chemical reaction with the halocarbon and/or the materials in the refrigeration system at the expected temperatures and operating conditions of the refrigeration system.

2. The system of claim 1, where the refrigeration system contains a reciprocating compressor, the oil has a viscosity at 38° C. of from about 75 SUS to about 500 SUS, the halocarbon refrigerant is a chlorofluorocarbon, and the lubricant composition contains from about 1 part to about 20 parts by weight of additive per 100 parts by weight of oil.

3. The system of claim 1, where, in the additive formula, X=CL and R=an alkyl group having from 8 to 18 carbon atoms.

4. The system of claim 1, where the oil has a pour point not greater than about −25° F.

5. The system of claim 1, where the oil is a polyalkylated benzene compound.

6. The system of claim 1, where the R group is a branched chain structure, and n=a number from 2 to 4.

7. The system of claim 1, where the additive is selected from the group consisting of octadecyl 2, 4, 6 trichlorophenyl ether; 2-ethylhexyl 2,4-dichlorophenyl ether; and 2-octyl 2,4-dichlorophenyl ether.

8. The system of claim 1, where the refrigeration system contains a reciprocating compressor operating at discharge temperatures up to about 130° C.

9. The system of claim 1, where the refrigeration system contains a reciprocating compressor having pistons reciprocating within cylinders closed by heads having discharge valves, where the valves operate at a temperature of about 130° C. and in which vaporous chlorofluorocarbon contacts lubricant composition in the area of the hot discharge valves.

* * * * *